United States Patent [19]

Furuya et al.

[11] Patent Number: 4,781,010

[45] Date of Patent: Nov. 1, 1988

[54] WRAPPING-PAPER FEEDING APPARATUS FOR USE IN COIN WRAPPER

[75] Inventors: Katsuke Furuya, Matsudo; Tomonari Sakurai, Urawa; Yoshio Oikawa, Warabi; Katsuyuki Miyamoto, Urawa, all of Japan

[73] Assignee: Laurel Bank Machines Co., Ltd., Tokyo, Japan

[21] Appl. No.: 97,340

[22] Filed: Sep. 11, 1987

Related U.S. Application Data

[63] Continuation of Ser. No. 832,998, Feb. 26, 1986, abandoned.

[30] Foreign Application Priority Data

Mar. 20, 1985 [JP] Japan ..... 60-40420[U]

[51] Int. Cl.[4] ..... B65B 11/04

[52] U.S. Cl. ..... 53/64; 53/212; 53/389

[58] Field of Search ..... 53/211, 212, 389, 64

[56] References Cited

U.S. PATENT DOCUMENTS

| | | | |
|---|---|---|---|
| 3,715,861 | 2/1973 | Odelberg | 53/211 |
| 3,821,917 | 7/1974 | Hatanaka | 53/212 X |
| 3,906,964 | 9/1975 | Ushio | 53/212 |
| 4,038,806 | 8/1977 | Rothman | 53/212 X |
| 4,219,985 | 9/1980 | Uchida et al. | 53/212 |
| 4,221,103 | 9/1980 | Uchida | 53/212 |
| 4,276,735 | 7/1981 | Miyazaki | 53/212 |
| 4,282,701 | 8/1981 | Miyazaki | 53/212 |
| 4,397,410 | 8/1983 | Schueler | 225/98 |

FOREIGN PATENT DOCUMENTS

| | | |
|---|---|---|
| 1454662 | 11/1976 | United Kingdom . |
| 1454664 | 11/1976 | United Kingdom . |
| 1467198 | 3/1977 | United Kingdom . |
| 1503437 | 3/1978 | United Kingdom . |
| 2034273 | 6/1980 | United Kingdom . |
| 2050288 | 1/1981 | United Kingdom . |

*Primary Examiner*—John Sipos

*Attorney, Agent, or Firm*—Fleit, Jacobson, Cohn & Price

[57] ABSTRACT

A wrapping-paper feeding apparatus for use in a coin wrapper includes a paper feeding roller for drawing wrapping paper out of a wrapping-paper storage portion, wrapping rollers for wrapping the wrapping-paper fed out of the paper feeding roller around accumulated coins and a cutter disposed between the paper feeding roller and the wrapping rollers. A paper cutting roller is disposed between the paper feeding roller and the wrapping rollers to impart tension to the wrapping paper so as to cut the wrapping paper by the cutter.

9 Claims, 3 Drawing Sheets

WRAPPING-PAPER FEEDING APPARATUS FOR USE IN COIN WRAPPER

This application is a continuation of application Ser. No. 832,998, filed Feb. 26, 1986, abandoned.

BACKGROUND OF THE INVENTION

The present invention relates to an apparatus which is disposed in a coin wrapper for the purpose of feeding wrapping-paper having the length required for the kind of coins being wrapped.

FIG. 4 is a schematic view showing one example of a conventional type of coin wrapper. A coin wrapper of this type wraps coins in such a manner that a stack of accumulated coins C of a predetermined number (for example, fifty coins) are surrounded by each of three wrapping rollers 1 and the stack of the coins C is then rotated by keeping each of the wrapping rollers 1 in contact with the periphery thereof, thereby wrapping a wrapping-paper 2 around the periphery of the rotating stack of coins C, and crimping the upper and lower portions of the wrapping-paper 2 after the wrapping-paper 2 is wrapped around the coins C.

Additionally, the wrapping-paper 2 for use in the above-mentioned coins wrapper which is supported for rotation about the axis of a shaft 3 in a rolled state, is fed out while being clamped between a paper feeding roller 4 and a driven roller 5, is then inserted between the stack of coins C and one of the wrapping rollers 1 through guide plates 6A and 6B, and thus is wrapped around the stack of coins C.

Also, the above-mentioned wrapping roller 1 imparts a tension to the wrapping-paper 2 by rotating at higher speed than the rotation of the paper feeding roller 4, thereby bringing the paper 2 into contact with a cutter 7 which cuts the wrapping-paper 2 into a piece having a predetermined length corresponding to the kind of coins C being wrapped (that is, the outer diameter of the coins C).

Further, the paper feeding roller 4, the driven roller 5 and the cutter 7 are disposed on a rotating frame 9 which is supported for rotation about the axis of a shaft 8 such that they can move in unison. Specifically, the rotating frame 9 is coupled by means of a coupling rod 12 and a pin 13, to a link arm 11 which is supported for rotation about the axis of a shaft 10. Thus, the frame 9 is rotated about the axis of the shaft 8 through the rotation of the link arm 11 by means of the cam 14, thereby causing the cutter 7 and other relevant components to move. In addition, position detecting cams 16A, 16B, 16C and 16D which are mounted on a cam shaft 15 for the cam 14 selectively actuate switches 17A, 17B, 17C and 17D in correspondence with the rotation angle of the cam shaft 15, thereby detecting the positions of the cutter 7 and other relevant components.

Also, in the above described wrapper, since each piece of the wrapping-paper 2 differs in length depending on the kind of coins being wrapped (the outer diameter of each coin C), it is necessary to adjust the length of the paper piece. Such adjustment is made by rotating the above-mentioned cam shaft 15.

Specifically, when the cam shaft 15 is rotated, the rotating frame 9 rotates about the axis of the shaft 8 so as to move the paper feeding roller 4, the driven roller 5 and the cutter 7, thus causing the cutter 7 to move to each position along the path of travel of the wrapping-paper 2 as shown by the chain line in FIG. 4. As the cutter 7 is located forward the downstream end in the terms of the direction in which the wrapping-paper 2 travels, the wrapping-paper 2 can be cut into a short piece in such a manner as to be suitable for the wrapping of small diameter coins.

However, the above described system involves the following problems.

(a) It is necessary to allow the mechanism including the paper feeding roller 4, the driven roller 5 and the cutter 7 in combination to be moved in order to adjust the length of the wrapping-paper 2, thus leading to complication of the mechanism.

(b) In association with the problem mentioned in the preceding paragraph(a), since the range within which the guide plate 6B may be disposed is rendered narrow and there is a tendancy of an upward curl of the wrapping-paper as viewed in FIG. 4. due to the fact that the wrapping-paper 2 is wound up in the form of a roll, the wrapping-paper 2 tends to run off its path of travel in the area away from the guide plate 6B.

(c) Since this prior art relies upon a system of cutting wrapping-paper by using the difference in velocity as between the two rolls, if the running speed of the wrapping-paper 2 is increased with the intention of speeding up a wrapping operation, large noise occurs at the time of cutting.

SUMMARY OF THE INVENTION

It is, therefore, an object of this invention to provide a wrapping-paper feeder apparatus which effectively overcomes the problems (a) to (c) mentioned above.

In order to achieve the above object, the present invention is arranged such that a paper feeding roller for drawing out wrapping-paper stored in a paper storage portion conducts either a paper feeding action for feeding out the wrapping-paper or a braking action for controlling the movement of the wrapping-paper by applying a brake thereto, a paper cutting roller being disposed between a paper feeding roller and a wrapping roller in order to bring the wrapping-paper into contact with a cutter by virtue of a tension applied to the wrapping-paper between the paper cutting roller and the paper feeding roller while in the state of being braked.

DESCRIPTION OF THE DRAWINGS

The present invention will now be described in detail with reference to the preferred embodiment illustrated in the accompanying drawings in which.

DESCRIPTION OF THE PREFERRED EMBODIMENTS

Figure 2:
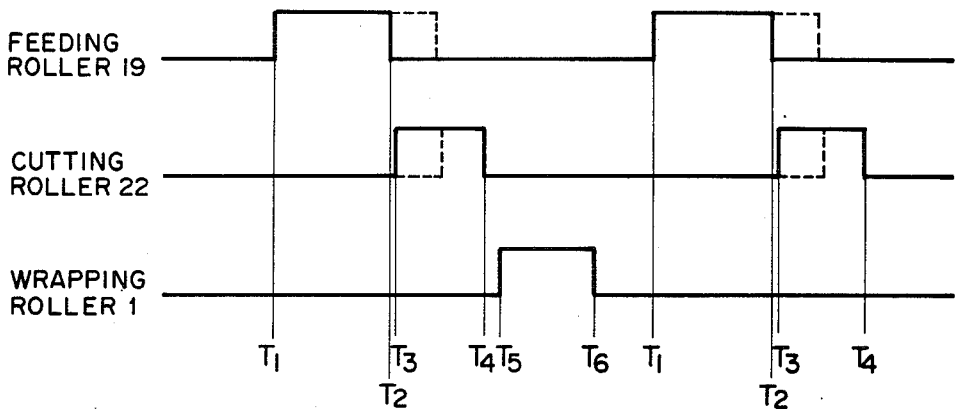
FIG. 2 is a timing chart showing an embodiment of the action of each roller schematically illustrated in FIG. 1.
Figure 3:
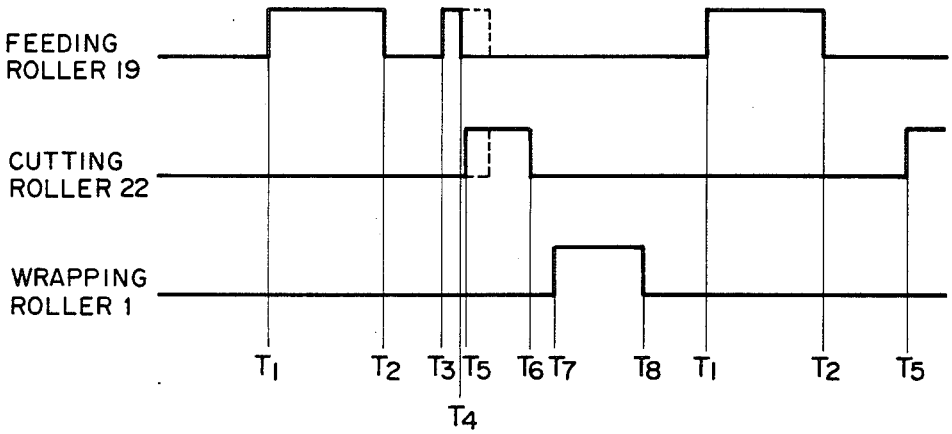
FIG. 3 is a timing chart showing another embodiment of the action of each roller schematically illustrated in FIG. 1.
Figure 4:
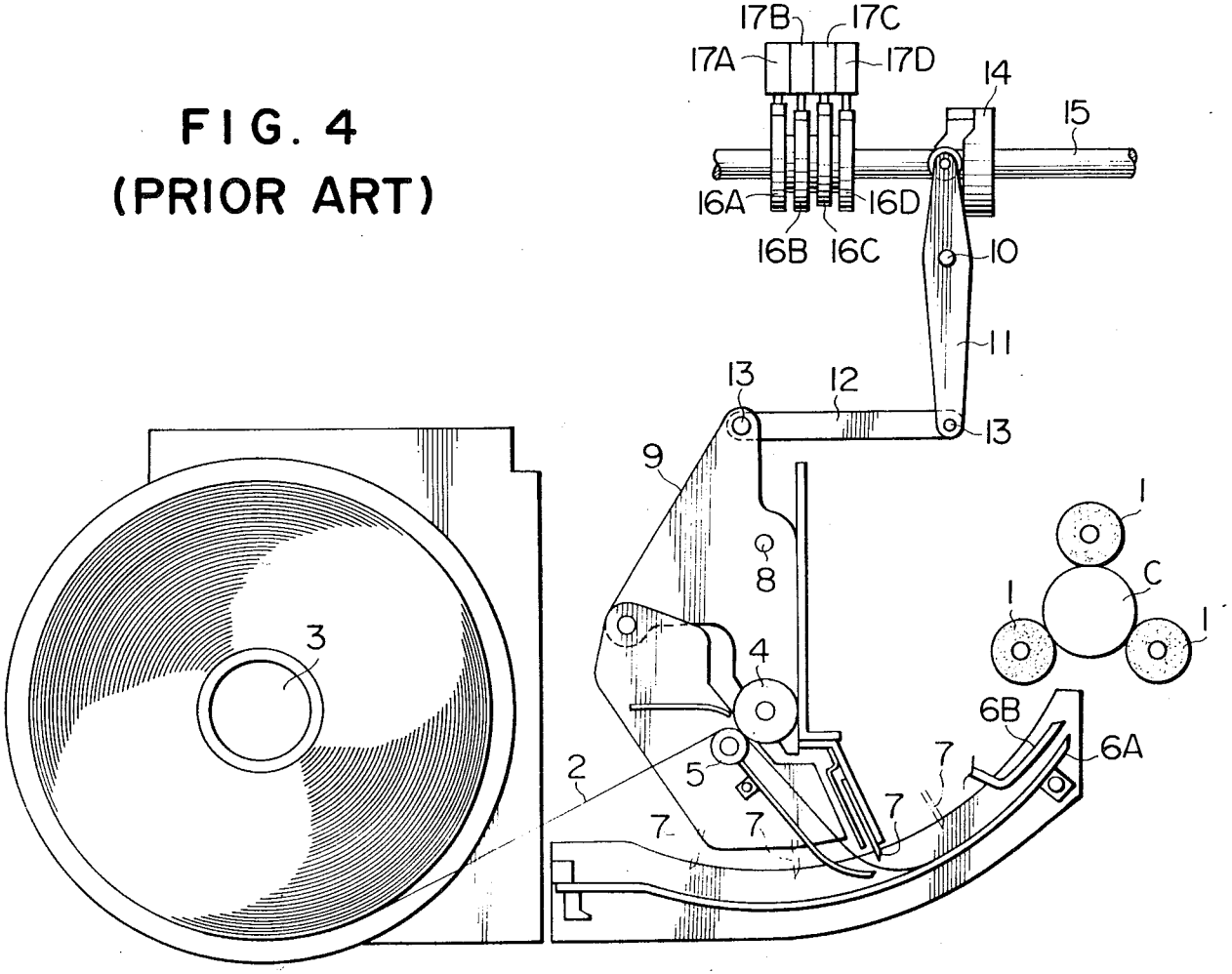
FIG. 4 (PRIOR ART)
FIG. 4 is a plan view of a conventional type of coin wrapper apparatus.

One preferred embodiment of the present invention will be described below with reference to FIGS. 1 and 3. In this description, the same components as those in FIG. 4 which are illustrated in FIGS. 1 through 3 are referred to using identical symbols for the sake of simplicity.

Figure 1:
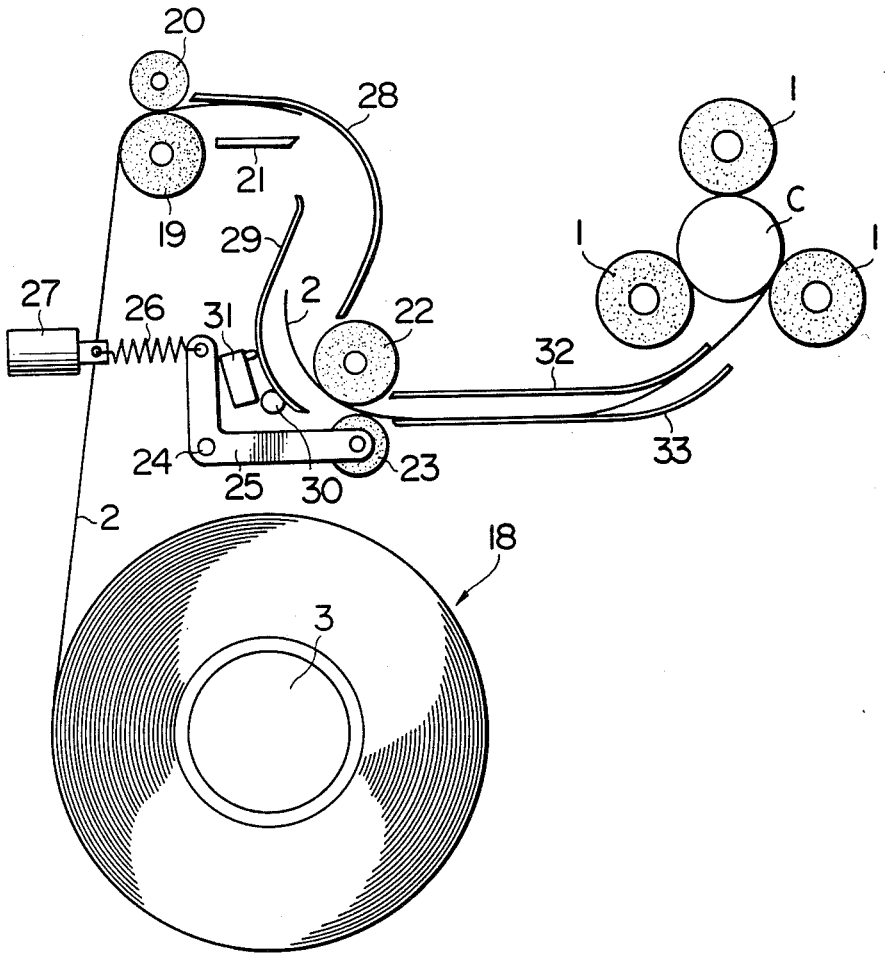
FIG. 1 is a plan view of the essential part of the apparatus in accordance with the present invention.

The wrapping-paper feeder apparatus of this invention, as shown in FIG. 1, comprises a wrapping-paper storage portion 18. A paper feeding roller 19 and a driven roller 20 for drawing out the wrapping paper 2 by clamping the paper therebetween are disposed above the wrapping-paper storage portion 18. Additionally, a paper cutting roller 22 and an auxiliary roller 23 are provided between the paper feeding roller 19 and the group of paper wrapping rollers 1, 1 and 1. The paper cutting roller 22 imparts a tension to the wrapping-paper 2 between the paper feeding roller 19 and the roller 22 to bring the paper 2 into contact with a cutter 21 the auxiliary roller 23 is adapted to clamp the wrapping-paper 2 between the paper cutting roller 22 and the roller 23. The auxiliary roller 23 is rotatably supported on one end of an L-shaped link 25 which is pivotably mounted on a shaft 24 and the L-shaped link 25 is arranged so as to be subjected to an angular moment which is clockwise as viewed in FIG. 1 (in other words, an angular moment which acts in a direction away from the paper cutting roller 22) by means of a torsion spring (not shown) disposed on the shaft 24. Additionally, the L-shaped link 25 is operated by a solenoid 27 which is coupled to one end of the link 25 via a tension spring 26 and is rotated counterclockwise as viewed in FIG. 1 against the angular moment.

A first and a second guide plates 28 and 29 are disposed along the cutting section which is formed between the paper feeding roller 19 and the paper cutting roller 22, and the wrapping-paper 2 is guided between the first and second guide plates 28 and 29. Additionally, the second guide plate 29 is supported for rotation about the axis of a shaft 30, and is urged in the clockwise direction as viewed in FIG. 1 by a torsion spring (not shown). Therefore, since the second guide plate 29 adjoins the wrapping paper 2 which is subjected to tension within the cutting section, the guide plate 29 functions to rotate counterclockwise as viewed in FIG. 1 about the axis of the shaft 30 so as to actuate a microswitch 31. A pair of guide plates 32 and 33 (third and fourth guide plates) are disposed along the paper feeding section which is formed between the paper cutting roller 22 and the group of the three wrapping rollers 1, and the pair of guide plates 32 and 33 are located with a fixed space therebetween in such a manner that the wrapping-paper 2 is allowed to pass therethrough without any resistance.

Description will be made below of the operation of the wrapping-paper feeder apparatus which is constructed in this manner with reference to the timing chart of FIG. 2. In the below description, $T_n$ represents an N-numbered timing.

$T_1$: The paper feeding roller 19 is rotated to draw the wrapping-paper 2 out of the storage portion 18.

$T_2$: After drawing out the wrapping-paper having a predetermined length corresponding to the diameter of coins being wrapped (the illustrated example represents the case of using the smallest diameter coin), the paper feeding roller 19 is stopped and, additionally, at least one of the rollers 19 and 20 is brought to a braked condition, thereby preventing the wrapping-paper 2 from moving through the rollers 19 and 20.

$T_3$: The solenoid 27 is operated to bring the auxiliary roller 23 into contact with the paper cutting roller 22 and the roller 22 is rotated. Thus, the leading end of the wrapping-paper 2 is guided through the space between the guide plates 32 and 33 and is then fed out toward the wrapping rollers 1. Meanwhile, the wrapping-paper 2, whose trailing end is held between the rollers 19 and 20, is subjected to a gradually increasing tension within the above-mentioned cutting section, and, after a certain time has passed from the timing $T_3$, the wrapping-paper 2 is cut by virtue of its contact with the cutter 21.

$T_4$: Increase and decrease in the tension applied to the wrapping-paper 2 are detected by the micro-switch 31 actuated by the second guide plate 29 which is pivotally moved in correspondence with changes in the tension of the wrapping-paper 2. Specifically, the second guide plate 29 is rotated counterclockwise as viewed in FIG. 1 by virtue of an increase in tension to operate the actuator of the microswitch 31 and is again rotated clockwise at the time of cutting the wrapping-paper 2, to disengage from the actuator of the microswitch 31, so that whether or not the wrapping-paper 2 has been cut is detected. Thereafter, the solenoid 27 is actuated to separate the auxiliary roller 23 from the paper cutting roller 22, and the paper cutting roller 22 is thus stopped, on the condition that the cutting of the wrapping-paper 2 has been completed and the leading end of the wrapping-paper 2 is clamped between one of the three wrapping rollers 1 and the stack of coins C being wrapped (whether or not the paper 2 is clamped is primarily determined in terms of the distance between the paper cutting roller 2 and the wrapping roller 1 as well as the peripheral velocity of the paper cutting roller 22).

$T_5$: After the paper cutting roller 22 has been stopped, the wrapping rollers 1 are rotated to wrap the wrapping-paper 2 around the periphery of the stack of coins C.

$T_6$: After the stack of coins C has been wrapped, the wrapping rollers 1 are stopped.

Upon completion of the foregoing wrapping operation over a complete cycle ranging from $T_1$ through $T_6$, the process returns to the above-mentioned $T_1$ and the same operation is subsequently repeated in accordance with the command of an operator.

Also, according to the embodiment of FIG. 2, the rotation of the paper feeding roller 19 and the paper cutting roller 22 are set to the same peripheral velocity, thus allowing a piece of the wrapping paper 2 to be fed out in lengths which have a constant relationship with time. Therefore, in a case where the coin C being wrapped has a larger diameter than the illustrated embodiment, in other words, the length of each piece of wrapping paper 2 is longer than that of the embodiment, the paper feeding roller 19 is, as shown by the broken lines in FIG. 2, rotated for a further period so as to feed out the longer piece of the wrapping-paper 2. In the meantime, as shown by the broken lines in FIG. 2, it suffices to shorten the operating time of the paper cutting roller 22 in proportion to lengthening of the operation time of the paper feeding roller 19. In this case, under the condition that the rotation speed of the paper feeding roller 19 is the same as that of the paper cutting roller 22, the following relationship holds irrespective of the length of the piece of the wrapping-paper 2 being supplied:

$$(T_2-T_1)+(T_4-T_3)=\text{constant}.$$

In other words, the total of the feed quantities of wrapping paper by the feeding roller and the cutting roller allow the leading end of the wrapping paper to reach the wrapping area.

It is to be noted that, in the embodiment shown in the figure, while respective time lags are provided between the timing $T_2$ of stopping the paper feeding roller 19 and the timing $T_3$ of starting the paper cutting roller 22 as well as between the timing $T_4$ of stopping the paper cutting roller 22 and the timing $T_5$ of starting the wrapping roller 1, the starting time may be synchronized with the stopping time in the respective cases.

Instead of the operations of starting ad stopping the wrapping roller 1 and the paper cutting roller 22, the same function described above can be obtained through the operation of bringing each wrapping roller 1 into contact with the stack of coins C and that of bringing the auxiliary roller 23 into contact with the paper cutting roller 22.

Referring now to FIG. 3 which is a timing chart showing another embodiment of the operation of the wrapping-paper feeder apparatus in accordance with the present invention, the operating time of the paper feeding roller 19 as shown in the timing chart of FIG. 2 is divided into the following two time intervals:

(a) Basic Time . . . $T_1-T_2$

The time interval required to supply a piece of the wrapping-paper 2 having such a length that is capable of wrapping the smallest diameter coin (one corresponding to a 1-yen coin currently used in Japan, i.e. one having a diameter of about 2 cm);

(b) Adjustment Time . . . $T_3-T_4$

The time interval required to supply a piece of the wrapping-paper 2 having a length equivalent to the difference between the length of a piece of the wrapping-paper 2 used in wrapping the stack of the smallest diameter coins and that of a piece of the paper 2 used in wrapping other kinds of coins.

In this case, supply of the wrapping-paper 2 is adjusted by changing the length of $T_3-T_4$. In a case where the apparatus of this invention is operated in accordance with this timing, as shown by the broken lines in FIG. 3, the time interval of $T_3-T_4$ is lengthened or shortened in correspondence with changes in the length of $T_5-T_6$, whereby the wrapping-paper 2 is cut into a piece having a suitable length and the piece thus obtained is then supplied, with the result that the stack of coins C can be wrapped by each wrapping roller 1 (see $T_7-T_8$).

Also, in a case where a stack of the smallest diameter coins is to be wrapped, as shown by a second successive cycle which starts after the above described $T_8$ has ended, shortly after the start-up ($T_1$) and the stoppage ($T_2$) of the paper feeding roller 19, the paper cutting roller 22 starts ($T_2$) and the wrapping-paper 2 is cut into a piece of a predetermined length.

It is to be noted that the operating time of the paper feeding roller 19 can be divided into half in this manner to increase the rotational speed of the paper feeding roller 19 which has no direct relationship with the wrapping operation conducted by the wrapping rollers and the cutting operation conducted by the paper cutting coller (in other words, to shorten the time required for the process from $T_1$ to $T_2$), thereby enabling shortening of the time required for the overall wrapping operation.

As will be seen from the above description, in accordance with the present invention, a paper cutting roller is disposed between a paper cutting roller for feeding wrapping-paper having a required length in correspondence with the kinds of coins being wrapped and wrapping rollers which are arranged to rotate while in contact with the periphery of the coins being wrapped, and, when the paper feeding roller stops in a state of braking the wrapping paper after feeding the paper having the required length, the paper cutting roller is rotated to apply tension to the paper such that it is cut into a piece having a predetermined length by virtue of its contact with a cutter. Therefore, the present invention exhibits the following excellent effects.

(i) Since the length of each piece of the wrapping-paper can be adjusted without changing the cutter position, no mechanism is needed to move rollers and the like for determining the path of travel of the wrapping-paper relative to the cutter, thereby enabling simplification of mechanism.

(ii) For the same reason set forth in the preceding paragraph (i), the apparatus of this invention does not need any member which requires to be changed in a mechanical fashion. Therefore, the degree of freedom in selecting the location of each guide plate which guides wrapping-paper is improved, whereby the wrapping-paper can be positively guided within the apparatus to stably maintain the path of travel of the paper.

(iii) Since it is possible to set the paper feeding velocity in cutting the wrapping paper irrespective of the coin wrapping velocity, the wrapping velocity can be increased while the occurrence of noise during cutting is prevented.

What is claimed is:

1. A wrapping-paper feeding apparatus for use in a coin wrapper, said feeding apparatus comprising:

paper feeding rollers for drawing wrapping paper out of a wrapping paper storage portion, wrapping rollers for wrapping around accumulated coins the wrapping paper which is fed out of the paper feeding rollers, a cutter disposed downstream of the paper feeding rollers for cutting the wrapping paper, paper cutting rollers disposed between the cutter and the wrapping rollers for selectively clamping the wrapping paper therebetween and for feeding the wrapping paper to the wrapping rollers only when the paper feeding rollers are stopped, means for mounting said cutting rollers for relative movement toward and away from each other, means for causing the paper feeding rollers to feed the wrapping paper a predetermined length in accordance with the kind of coins while the paper cutting rollers are stopped, and means for causing the paper cutting rollers to feed the wrapping paper while at the same time the paper feeding rollers are stopped to thereby tension the wrapping paper between the paper cutting rollers and the stopped paper feeding rollers to engage the wrapping paper with the cutter to cut the wrapping paper a length suitable for wrapping the coins in accordance with the kind of coins, tension detecting means for detecting tension on the wrapping paper as the wrapping paper is tensioned between the paper cutting rollers and the paper feeding rollers and for indicating when tension on the wrapping paper is released due to the cutting of the wrapping paper, means responsive to a release of tension on the wrapping paper due to the wrapping paper having been cut to separate the paper cutting rollers.

2. An apparatus according to claim 1, wherein one of the paper cutting rollers is movable toward and away from the other.

3. An apparatus according to claim 2, wherein a solenoid is provided for causing one of the paper cutting rollers to move.

4. An apparatus according to claim 1, wherein the paper cutting rollers are rotated at the same speed as that of the paper feeding rollers.

5. An apparatus according to claim 1, wherein the paper cutting rollers are driven to rotate a predetermined period after the wrapping paper is cut to feed the wrapping paper toward the wrapping rollers.

6. An apparatus according to claim 1, wherein a period within which the paper feeding rollers are driven is adjustable and a period within which the paper cutting rollers are driven is adjustable.

7. A wrapping-paper feeding apparatus for use in a coin wrapper, said feeding apparatus comprising:

paper feeding rollers for drawing wrapping paper out of a wrapping paper storage portion, wrapping rollers for wrapping around accumulated coins the wrapping paper which is fed out of the paper feeding rollers, a cutter disposed downstream of the paper feeding rollers for cutting the wrapping paper, paper cutting rollers disposed between the cutter and the wrapping rollers for selectively clamping the wrapping paper therebetween and for feeding the wrapping paper to the wrapping rollers only when the paper feeding rollers are stopped, means for mounting said cutting rollers for relative movement toward and away from each other, means for causing the paper feeding rollers to feed the wrapping paper a predetermined length in accordance with the kind of coins while the paper cutting rollers are stopped, and means for causing the paper cutting rollers to feed the wrapping paper while at the same time the paper feeding rollers are stopped to thereby tension the wrapping paper between the paper cutting rollers and the stopped paper feeding rollers to engage the wrapping paper with the cutter to cut the wrapping paper a length suitable for wrapping the coins in accordance with the kind of coins, means responsive to a release of tension on the wrapping paper due to the wrapping paper having been cut to separate the paper cutting rollers.

8. A wrapping-paper feeding apparatus according to claim 1, wherein means responsive to a release of tension on the wrapping paper due to the wrapper paper having been cut actuates rotation of the wrapping rollers.

9. A wrapping-paper feeding apparatus according to claim 1, wherein means responsive to a release of tension on the wrapping paper due to the wrapper paper having been cut actuates rotation of the wrapping rollers.

* * * * *